United States Patent [19]

Setzer et al.

[11] 4,010,046

[45] Mar. 1, 1977

[54] METHOD OF EXTRUDING ALUMINUM BASE ALLOYS

[75] Inventors: William C. Setzer, Creve Coeur, Mo.; Richard D. Lanam, Hamden; Joseph Winter, New Haven, both of Conn.; Douglas L. Graham, Ballwin, Mo.

[73] Assignee: Swiss Aluminium Ltd., Chippis, Switzerland

[22] Filed: Mar. 4, 1976

[21] Appl. No.: 663,661

[52] U.S. Cl. ..... 148/11.5 A; 75/143; 148/12.7 A; 148/32; 148/32.5

[51] Int. Cl.[2] ..... C22D 1/04

[58] Field of Search ..... 148/32, 11.5 A, 12.7 A, 148/32.5; 75/143

[56] References Cited

UNITED STATES PATENTS

| | | | |
|---|---|---|---|
| 2,614,053 | 10/1952 | Bobb et al. | 148/12.7 A |
| 3,104,189 | 9/1963 | Wagner | 75/143 |
| 3,762,962 | 10/1973 | Nilsson | 148/12.7 A |

FOREIGN PATENTS OR APPLICATIONS

| | | | |
|---|---|---|---|
| 891,678 | 3/1962 | United Kingdom | 148/11.5 A |

*Primary Examiner*—W. Stallard
*Attorney, Agent, or Firm*—Robert A. Dawson; Robert H. Bachman; David A. Jackson

[57] ABSTRACT

A method of extruding aluminum base alloys having high strength and high electrical conductivity properties which comprises providing an aluminum base alloy containing from 0.04 to 1.0% iron, from 0.02 to 0.2% silicon, from 0.1 to 1.0% copper, from 0.001 to 0.2% boron, balance essentially aluminum; heating the cast alloy ingot or billet to a desired extrusion temperature, extruding the material, cooling the extruded product, drawing down the cooled product, and finally aging the drawn product. The alloy material utilized may be homogenized before being extruded.

13 Claims, No Drawings

METHOD OF EXTRUDING ALUMINUM BASE ALLOYS

BACKGROUND OF THE INVENTION

The present invention relates to the art of making aluminum base alloy extruded products and is particularly concerned with extruded products which exhibit high strength and high electrical conductivity properties.

The extrusion process involves forcing the aluminum base alloy stock through a die opening having a predetermined configuration in order to form a shape having an indefinite length and a substantially constant cross-sectional area. This die extrusion process involves preheating the aluminum base alloy stock and placing the preheated stock in a cylinder which itself is usually heated. The cylinder has a suitable die placed at one end thereof and a reciprocating ram or piston arrangement having approximately the same cross-sectional dimensions as the bore of the cylinder. This ram is pressed against the heated alloy stock in order to compress the stock and thus force the alloy to flow through the die opening. Pressure exerted by the ram on the alloy stock during the compression operation raises the internal temperature of the stock as a result of internal friction within the stock body.

Properties of shaped aluminum base alloys formed from extrusion processes are generally determined by the temperature of the alloy before extrusion and the speed of extrusion. A balance between high alloy temperature combined with low extrusion speed on the one hand, and low alloy temperature combined with high extrusion speed on the other hand, should be struck for the most economical extrusion operation and consistent properties of the extruded product.

An important limiting factor in the extrusion of an aluminum base alloy is the extrusion speed. Too high a rate of speed causes what is known as chatter cracking in the extruded alloy material. This cracking phenomenon consists of surface defects in the extruded material which form a pattern of fine transverse cracks resulting from longitudinal tensile stresses which are quite high compared with the strength of the alloy at the working temperature. These fine cracks may not affect the overall strength of the extruded product but they do detract from the surface appearance, finishing ability, dimensional accuracy and mechanical integrity of the extruded product. It is well known that the chatter cracking phenomenon occurs at lower extrusion speeds as the extrusion temperature is raised. High strength aluminum base alloys must be extruded more slowly and at lower temperatures than regular aluminum or aluminum alloy materials in order to avoid the chatter cracking. This suggests that there is a relationship between flow stress and cracking tendency due to rises in extrusion surface temperature caused by adiabatic heating.

SUMMARY OF THE INVENTION

The present invention comprises a method of extruding high strength aluminum base alloys which exhibit superior strength properties than those exhibited by commercially available electrical grade aluminum (EC) or other aluminum base alloys and electrical conductivity values approaching those exhibited by EC aluminum.

Accordingly, it is a principal object of the present invention to provide a method of extruding aluminum base alloys which exhibit both high strength and high electrical conductivity.

It is a further object of the present invention to provide a method as aforesaid which minimizes the occurrence of chatter cracking in the extrusion of said aluminum base alloys.

Further objects and advantages of the present invention will appear hereinbelow.

DETAILED DESCRIPTION

In accordance with the present invention, it has been found that the foregoing objects and advantages can be readily achieved, and that aluminum base alloys having high strength and electrical conductivity properties may be successfully extruded without expensive and complicated extrusion methods.

An aluminum base alloy which has been used in extrusion operations to provide final products having high electrical conductivities is Aluminum Association Alloy 1060. Typical properties of alloy 1060 are a yield strength of 12–13 ksi and an electrical conductivity of at least 54 percent IACS. The aluminum base alloys used in the present invention provide products with properties which are stronger than alloy 1060 and which approach it in electrical conductivity performance.

One determination which must be made in any extrusion process is the extrudability of the material being worked. In the extrusion of aluminum base alloys, alloy 1060 is relatively easy to extrude, while Aluminum Association Alloys 6061 and 6063, which have also been used in this art, are respectively hard and easy to extrude. A balance must be struck between relative ease of extrusion and properties desired in the extruded product. Naturally, the preferred alloy would be one which extrudes easily and exhibits a combination of high strength and high electrical conductivity. Generally, however, the aluminum base alloys which are easiest to extrude are weaker than alloys exhibiting high extrusion resistance.

The aluminum base alloys which are used in the present invention generally contain from 0.04 to 1.0 percent iron, from 0.02 to 0.2 percent silicon, from 0.1 to 1.0 percent copper, from 0.001 to 0.2 percent boron, balance essentially aluminum. The iron, silicon and boron alloying additions are substantially contained in the alloy matrix in a dispersion of extremely fine precipitates. The copper alloying addition is substantially present in solid solution to provide some solid solution strengthening of the matrix rather than as a dispersion or precipitation hardening agent, as is normally the case for this alloying element.

The extrusion process of the present invention includes the steps of casting, extruding, drawing and annealing of the alloy material. The aluminum base alloy ingots may be produced by any of the well known casting processes, the continuous or semi-continuous method being one of the most commonly used at present. One product which may be produced by the present extrusion process is tubing. Of course, solid shaped alloy rods may also be produced by the extrusion process.

The cast alloy ingot or billet may or may not be homogenized, if desired to obtain specific properties, at 750°–1100° F for 1 hour or more. The cast billet is then placed in the extrusion cylinder where force is applied thereto by an extrusion ram or piston. The amount of force applied to the cast billet will depend upon the extrusion speed desired and the particular alloying ingredients present in the cast material. In the alloys used herein, the alloying ingredient which most affects the extrudability is iron. Low iron contents will generally provide an alloy which will extrude better than higher iron versions of the same alloy. As will be seen from the examples described herein, the addition of copper to the alloy system may also affect extrudability. It would appear, however, that any increase in copper content present in the alloy beyond 0.22 percent does not significantly change the extrudability of the alloy.

The cast billet, whether homogenized or not, is heated to a temperature which provides good extrusion speeds. The cast billet is generally heated to 600°–950° F and preferably 910°–930° F. The extruded product is cooled either in air or by a liquid. The cooled product may be then stretched less than 3 percent of the length of the extruded shape.

The extruded bar or tube may be drawn down to a desired final diameter or other size if desired. This drawing operation generally helps to increase the physical properties of the extruded alloy. Working of the extruded material to at least a 20 percent reduction is preferred for those applications which require higher strength or dimensional tolerance in the worked material.

Following drawing of the extruded alloy, the worked product may be partially annealed at a temperature ranging from 300° to 450° F for 1 to 24 hours in order to raise the electrical conductivity (% IACS) and the ductility of the alloy. The worked product may be subjected to a full annealing procedure at a temperature ranging from 650° to 700° F for 2 to 4 hours in order to provide greater ductility in the alloy at the expense of yield strength (e.g., a lowering of yield strength to approximately 8 ksi).

An explanation of the experimental procedures involved in the exampes is in order. The extrusion process was simulated in order to provide consistent values for both strength and electrical conductivity properties of the alloys used in this invention and alloys currently in use in this art. The simulation procedures involved what will be termed hot torsion and hot rolling processes.

The hot torsion process is a measure of shear stress in a cylindrical bar of aluminum base alloy having a radius $r$. This bar is subjected to a torsional moment at one end which can be expressed in terms of an applied torque, M. This moment is resisted by a shear stress, $\tau$, set up in the cross section of the cylindrical bar. Equating the twisting moment to the internal resisting moment results in the development of an equation describing the shear stress in the bar. The maximum shear stress in the bar is thus derived as:

$$\tau_{max} = \frac{3\,M_{max}}{2\,\pi\,r^3} \qquad \text{(Eq.1)}$$

where $\tau_{max}$ = Maximum shear stress (psi)
$M_{max}$ = Maximum applied torque ($lb_f$)
$r$ = Radius of cylindrical alloy bar (in.)

The hot rolling process is a measure of flow stress in a slab of aluminum base alloy milled from an as-cast ingot. The flow stress is calculated from the roll mill separating force measurements according to the following equation:

$$F = \frac{P}{W\sqrt{R(h_o - h_f)}} \qquad \text{(Eq. 2)}$$

where $F$ = Flow Stress (psi)
$P$ = Separating force ($lb_f$)
$W$ = Sample width (in.)
$R$ = Roll Radius (in.)
$h_o$ = Initial thickness of sample slab (in.)
$h_f$ = Final thickness of sample slab (in.)

The greater the flow stress value, the harder it is to extrude the alloy.

The present invention will be more readily apparent from a consideration of the following illustrative examples.

EXAMPLE I

The aluminum base alloy used in the present invention, here called Alloy A, contained 1.0% iron, 0.22% copper, 0.01% boron with the balance being essentially aluminum. This alloy was compared with EC aluminum and Aluminum Association Alloys 6061 and 6063 in a hot torsion simulation of extrusion. The torsion procedure was performed on 0.484 inch diameter rods which necked down in the center of each to a diameter of 0.312 inch. Three temperatures of interest were taken for each sample rod; these were 750°, 840° and 930° F. The average strain rate for the torsion procedure was 135 min.$^{-1}$.

The rods subjected to torsion were heated by a furnace which was set approximately 20° F higher than the desired test temperature. This test temperature was monitored with a thermocouple embedded in the shoulder of each specimen. The rods were subjected to torsion when this temperature reading was from 2° to 4° F below the desired test temperature. The EC samples tended to "weld" at 840° F rather than fracture during the test. Therefore, EC was not tested at 930° F. The results of the hot torsion test for the alloy contemplated by the present invention and the alloys already in use are shown in Table I.

TABLE I

| Hot Torsion Data | | |
|---|---|---|
| Sample | Temperature (° F) | Maximum Shear Stress (psi) |
| Alloy A | 750 | 4920 ± 100 |
| EC | 750 | 2970 ± 150 |
| 6061 | 750 | 6300 ± 100 |
| 6063 | 750 | 4650 ± 100 |
| Alloy A | 840 | 3950 ± 150 |
| EC | 840 | 2190 ± 150 |
| 6061 | 840 | 4500 ± 100 |
| 6063 | 840 | 3620 ± 100 |
| Alloy A | 930 | 2970 ± 100 |
| EC | 930 | not taken |
| 6061 | 930 | 3500 ± 100 |
| 6063 | 930 | not taken |

The results of Table I indicate that temperature has a strong effect upon the shear stress of each sample. These results also indicate that Alloy A exhibits a higher shear strength at each temperature than the most commonly extruded materials, EC and Alloy 6063. From these results a "ranking" of each material from most to least extrudable may be performed. This ranking is, in order, EC, 6063, Alloy A and 6061.

EXAMPLE II

Variations of Alloy A with differing amounts of iron and copper, along with Alloy A itself, were utilized in a hot rolling simulation of extrusion in comparison with EC aluminum and Aluminum Association Alloy 1060. The variations were designated as Alloy B, Alloy C and Alloy D, which contained respectively 0.6% iron, 0.22% copper, 0.01% boron; 0.2% iron, 0.22% copper, 0.01% boron; 1.0% iron, 0.4% copper, 0.01% boron, balance essentially aluminum in all cases Alloy 1060 contained 0.25% iron, 0.15% silicon, balance essentially aluminum.

Slabs with dimensions of 0.75 in. by 2 in. by 4 in. of each material were milled from the as-cast ingots. Thermocouples were embedded in the samples to monitor the temperature of each. The mill was set for 150 ft/min. unloaded. Each sample was held at 915° F for 5 minutes after reaching temperature and then was given a single reduction of 80%. Upon exiting from the mill, each slab was held for 10 seconds and water quenched.

The flow stresses calculated from the hot rolling experiment are presented for the six alloys in Table II.

TABLE II

| Data for Hot Rolling Simulation of Extrusion Process | | |
|---|---|---|
| Alloy | Temperature (° F) | Flow Stress (psi) |
| A | 920 | 21,700 ± 800 |
| B | 920 | 18,900 ± 500 |
| C | 915 | 17,150 ± 50 |
| D | 915 | 21,150 ± 850 |
| 1060 | 915 | 16,300 ± 50 |
| EC | 920 | 15,800 ± 50 |

An extrudability ranking of each material from the most to the least extrudable may be made from Table II. This ranking is, in order, EC, 1060, Alloy C, Alloy B, Alloy D and Alloy A. The difference in the flow stress of Alloys D and A is less than the difference in flow stress obtained for duplicates of each sample. Therefore, no major difference in the extrudability of these two alloys is anticipated.

The relative extrudability of aluminum base alloys currently being commercially used may be shown in Table III.

TABLE III

| Relative Extrudability of Common Aluminum Alloys* | |
|---|---|
| Alloy | Relative Extrudability** |
| EC | 160 |
| 1060 | 135 |
| 1100 | 135 |
| 3003 | 120 |
| 6063 | 100 |

TABLE III-continued

| Relative Extrudability of Common Aluminum Alloys* | |
|---|---|
| Alloy | Relative Extrudability** |
| 6061 | 60 |
| 2011 | 35 |
| 5086 | 25 |
| 2014 | 20 |

*From VanHorn, K. (ed.) Aluminum, Vol. III, American Society for Metals, 1967. p. 95.
**The relative extrudability is based on the average extrusion rate. Alloy 6063 is assigned a base value of 100.

The higher the relative extrudability number, the easier it is to extrude the material.

From Examples I, II and Table III, a relative extrudability table may be set up for the materials utilized in the Examples. These data are set forth in Table IV. As may be seen from Table IV, the relative extrudabilities of the family of alloys contemplated by the present invention lie in the range of 90 to 120. The major alloying addition within Alloys A, B, C and D which affects the relative extrudability is iron. Alloy C, which contains the lowest amount of iron, may be expected to approach the well-known easily extrudable EC and 1060 alloys as well as being more extrudable than the most commonly extruded 6063 alloy. Alloys A, B and D, which contain higher amounts of iron, should be expected to extrude either slightly poorer or approximately as easily as Alloy 6063 and much easier than Alloy 6061. Thus, the extrudability of all the alloy compositions contemplated by the present invention is adequate for commercial use.

TABLE IV

| Relative Extrudability of the Aluminum Alloys Evaluated in the Study at 920° F | | | |
|---|---|---|---|
| Alloy | Flow Stress (psi) | Maximum Shear Stress (psi) | Relative Extrudability |
| EC | 15,800 | 1600* | 160 |
| 1060 | 16,300 | — | 135 |
| C | 17,150 | — | 110–120 |
| B | 18,900 | — | 100–110 |
| A | 21,700 | 3000 | 90–100 |
| D | 21,050 | — | 90–100 |
| 6063 | | 2900* | 100 |
| 6061 | | 3600 | 60 |

*Extrapolated from 750 and 840° F.

EXAMPLE III

Room temperature mechanical properties and electrical conductivities were determined for the four alloys (A, B, C, D) utilized in Example II and Aluminum Association Alloy 1060 in four conditions:

1. As-extruded
2. As-extruded plus 30% cold rolled
3. As-extruded plus 50% cold rolled
4. As-extruded plus 75% cold rolled These results are tabulated in Table V.

TABLE V

| Tensile Properties and Electrical Conductivity Post Hot Rolling | | | | | |
|---|---|---|---|---|---|
| Alloy | Processing | 0.2 Y.S. (ksi) | UTS (ksi) | % Elong. 2" | Cond. % IACS |
| A | As Hot Rolled | 11.6 | 17.2– | 25.5– | 59.2– |
| B | As Hot Rolled | 11.3 | 16.2 | 25.0 | 59.1 |
| C | As Hot Rolled | 9.9 | 14.5 | 30.0 | 59.6 |
| D | As Hot Rolled | 11.6 | 18.3– | 23.5– | 58.3– |
| 1060 | As Hot Rolled | 9.4 | 13.8 | 32.5 | 60.5 |

TABLE V-continued

Tensile Properties and Electrical Conductivity Post Hot Rolling

| Alloy | Processing | 0.2 Y.S. (ksi) | UTS (ksi) | % Elong. 2" | Cond. % IACS |
|---|---|---|---|---|---|
| A | As Hot Rolled + 30% C.W. | 20.4 | 22.4 | 8.0 | 58.4 |
| B | As Hot Rolled + 30% C.W. | 19.6 | 21.3 | 8.0 | 59.3 |
| C | As Hot Rolled + 30% C.W. | 17.4 | 18.4 | 8.5 | 59.8 |
| D | As Hot Rolled + 30% C.W. | 22.3 | 24.1 | 6.0 | 58.3 |
| 1060 | As Hot Rolled + 30% C.W. | 16.0 | 17.7 | 9.5 | 60.1 |
| A | As Hot Rolled + 50% C.W. | 23.5 | 25.6 | 6.0 | 58.8 |
| B | As Hot Rolled + 50% C.W. | 21.9 | 24.1 | 5.5 | 59.4 |
| C | As Hot Rolled + 50% C.W. | 19.7 | 21.4 | 7.5 | 60.6 |
| D | As Hot Rolled + 50% C.W. | 24.9 | 26.7 | 5.0 | 58.5 |
| 1060 | As Hot Rolled + 50% C.W. | 18.4 | 20.4 | 7.5 | 60.8 |
| A | As Hot Rolled + 75% C.W. | 26.7 | 29.6 | 3.5 | 59.1 |
| B | As Hot Rolled + 75% C.W. | 25.7 | 28.0 | 4.0 | 59.3 |
| C | As Hot Rolled + 75% C.W. | 23.2 | 24.6 | 4.0 | 60.2 |
| D | As Hot Rolled + 75% C.W. | 27.9 | 30.6 | 3.0 | 58.3 |
| 1060 | As Hot Rolled + 75% C.W. | 20.9 | 23.1 | 5.5 | 60.8 |

As may be seen from Table V, The electrical conductivity of each alloy may be ranked from highest to lowest conductivity. This ranking is, in order, 1060, C, B, A and D. These conductivities range from 58.3 to 60.5% IACS. No major affect on conductivity due to cold working of the as-hot-rolled material can be noted from Table V. The alloys contemplated by the present invention exhibit higher strength and greater resistance to elongation than Alloy 1060 while approaching it in electrical conductivity properties. As may also be noted from Table V, the yield strengths and tensile strengths of each alloy are inversely related to the electrical conductivity of each alloy. Both the yield and tensile strength increase as the amount of cold working increases for all of the alloys. As may also be seen from Table V, percent elongation is also an inverse function of cold working for all of the alloys. The ranking of each alloy from the most to the least ductile is the same as the ranking for electrical conductivity.

Based on the hot torsion testing and the separating force measurements made during the hot rolling procedures, the family of aluminum base alloys (A, B, C, D) utilized in the present invention should exhibit extrudability values approximating that of Aluminum Association Alloy 6063, which is the alloy most commonly extruded and which is considered a highly extrudable alloy. The ease of extrusion for Alloys A, B, C and D will depend upon the iron composition of each alloy. At the higher iron composition, extrusion of the pertinent alloys will be slightly more difficult than 6063, while at the lower iron composition, extrusion will be somewhat easier than 6063. Therefore, the present invention, in combination with the alloys previously disclosed (A, B, C, D), which provide a viable alternative to the extrusion of Alloy 6063.

The tensile and yield strength data for the simulated as-extruded plus extruded and drawn alloys utilized in the present invention are generally superior to the strength properties of Aluminum Association Alloy 1060 under the same conditions. The electrical conductivities of the alloys utilized in the present invention are very close to the conductivity values exhibited by Alloy 1060 under the same conditions. Therefore, the process of the present invention produces a product which is a superior alternative to Alloy 1060 for the same intended uses as Alloy 1060.

The generally superior strength properties exhibited by the alloys used in the present invention provide a superior end product compared to similar products produced by the various Aluminum Association Alloys discussed hereinabove. An extruded product which may take full advantages of these superior strength properties is tubing. The size of the tubing will depend upon intended uses but generally speaking, a tube made from the alloys used in the present invention will, size for size, exhibit superior strength properties as compared to tubing made from other commercial alloys. Naturally, any shaped or sized extruded product may be produced by the present invention, limited only by the intended use and the limitations of the extruding apparatus and extruding die.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method for extruding high strength aluminum base alloys which comprises providing a cast alloy billet, the alloy billet consisting essentially of from 0.04 to 1.0% iron, from 0.02 to 0.2% silicon, from 0.1 to 1.0% copper, from 0.001 to 0.2% boron, balance essentially aluminum, conducting a hot extrusion of said billet at a temperature between 600°–950° F, cooling the extruded product and stretching the cooled product less than 3 percent of the length of the extruded shape.

2. The method of claim 1 wherein said extrusion is performed at a temperature of from 910° to 930° F.

3. The method of claim 1 wherein the extruded product is cooled either in air or a liquid.

4. The method of claim 1 wherein the cooled stretched product is cold worked to a reduction in area of at least 20 percent.

5. The method of claim 4 wherein the worked product is partially annealed at a temperature ranging from 300° to 450° F for 1 to 24 hours.

6. The method of claim 4 wherein the worked product is annealed at a temperature ranging from 650° to 700° F for 2 to 4 hours.

7. The method of claim 1 wherein said cast alloy billet is homogenized at a temperature of from 750°–1100° F for at least 1 hour before being extruded.

8. Welded tubing formed from a porthole die and seamless tubing produced by the method of claim 1.

9. Solid shaped bar produced by the method of claim 1.

10. Welded tubing formed from a porthole die and seamless tubing produced by the method of claim 5.

11. Solid shaped bar produced by the method of claim 5.

12. Welded tubing formed from a porthole die and seamless tubing produced by the method of claim 6.

13. Solid shaped bar produced by the method of claim 6.

* * * * *